United States Patent [19]

Pope

[11] 4,281,781

[45] Aug. 4, 1981

[54] HOSE EVERTING METHOD AND APPARATUS THEREFOR

[76] Inventor: William H. Pope, 146 Chestnut, Winnetka, Ill. 60093

[21] Appl. No.: 3,220

[22] Filed: Jan. 15, 1979

[51] Int. Cl.[3] ..... A41H 43/02; A41B 11/00

[52] U.S. Cl. ..... 223/39; 223/43

[58] Field of Search ..... 223/39, 40, 41, 42, 223/43; 112/262

[56] References Cited

U.S. PATENT DOCUMENTS

| | | | |
|---|---|---|---|
| 1,793,856 | 2/1931 | Johnson | 223/42 |
| 2,869,765 | 1/1959 | Laxson | 223/43 |
| 3,887,120 | 6/1975 | Harrill | 223/39 X |
| 3,941,285 | 3/1976 | Bailey | 223/43 |

FOREIGN PATENT DOCUMENTS

| | | | |
|---|---|---|---|
| 1088527 | 3/1955 | France | 223/39 |
| 784206 | 10/1957 | United Kingdom | 223/39 |

*Primary Examiner*—Louis Rimrodt
*Attorney, Agent, or Firm*—Hume, Clement, Brinks, Willian & Olds, Ltd.

[57] ABSTRACT

An improved method of everting a knitted sleeve-like portion of wearing apparel or the like, such as a hose precursor before the toe end is stitched, which includes drawing such sleeve over the free end of a cylindrical mounting tube and over and past a turning ring on said tube, which turning ring prevents the following end of the sleeve from sliding back towards the tube's free end when the drawing motion is reversed, pulling the leading end of the sleeve back over the sleeve towards the tube's free end. The simple drawing motion and reversal thereof not only everts the sleeve but positions the leading end free about the tube's free end, in position for stitching when the leading end is the toe end of a sock or other hose. Also provided is an apparatus for use in this method.

10 Claims, 7 Drawing Figures

HOSE EVERTING METHOD AND APPARATUS THEREFOR

TECHNICAL FIELD

This invention relates to the technical field of manufacturing knitted items, such as hose, including socks and other similar wearing apparel. This invention particularly relates to an improved method of and apparatus for everting, or turning inside out, a hose blank during the manufacture of the hose. This invention relates to an improved method of everting any knitted sleeve-like garment or portion of a garment during the manufacture thereof, and apparatus for use in the improved method.

BACKGROUND OF THE INVENTION

Hose such as socks are normally knitted as an elongated tube or sleeve with both longitudinal extremities left open. This elongated sleeve or blank can be considered the precursor of a sock with its toe end open. The sock blank is generally knitted right side out with its end opposite the toe, the welt of the sock, having a finished edge or hem. To complete the manufacture, the sock must be everted, or turned inside out, and the toe end stitched closed.

A sock can of course be everted by hand without the use of any apparatus, but such a method is inefficient for the mass production of socks. A sock blank is therefore generally everted with the use of a vacuum tube, a tube having a free open end and having a vacuum applied at the other. The blank is positioned partially within this vacuum tube, toe end first. The top of the sock or welt end is turned over the edge of the tube's open end and then slid along the outside of the tube. The toe end is drawn back towards the open end of the vacuum tube. The blank is everted when the toe end reaches the open end of the vacuum tube. It is common then to clamp the toe end in preparation for sewing or stitching the toe end closed.

Most all of these steps or select ones thereof can be done mechanically, and of course any of these steps can be done manually. Regardless of whether done mechanically or manually, this method of everting socks is nonetheless time consuming, requiring two distinct and unrelated steps, i.e., placing the toe end of the sock within the vacuum tube and drawing the welt end along the outside of the tube. Moreover, the turning of the welt end around the edge of the open end of the vacuum tube while a vacuum is being applied is a troublesome step that must be done with care to avoid the entire sock blank from being drawn into the vacuum tube. Although mechanical fingers for drawing or pulling the sock down the tube are known, they are not suitable for the prior step of turning the welt end over the edge of the vacuum tube.

It is an object of the present invention to provide a new method of and apparatus for everting a hose blank that does not require application of vacuum during the everting process. It is an object of the invention to provide such a method and apparatus by which a hose blank can be everted simply and efficiently regardless of whether done manually or mechanically. It is an object to provide a method of and apparatus for everting a hose blank which can be performed by mechanical fingers well known to those skilled in the art and requires only a single function and the reversal thereof.

DISCLOSURE OF THE INVENTION

These and other objects are realized in accordance with the invention by a method wherein a knitted sleeve or hose blank is drawn over a cylindrical mounting tube at its free end until the entire sleeve passes a means for resisting sliding on the mounting tube. Thereafter the leading end of the sleeve is drawn back over itself. The means for resisting sliding will retard the following end of the sleeve, allowing the leading end to pass over the rest of the sleeve easily, without the following end simultaneously sliding towards the free end of the mounting tube. The following end of the sleeve will not pass the means for resisting sliding until the sleeve has been substantially completely everted at which time the following end will again be drawn over the means for resisting sliding.

PREFERRED EMBODIMENTS OF THE INVENTION

Figure 1:
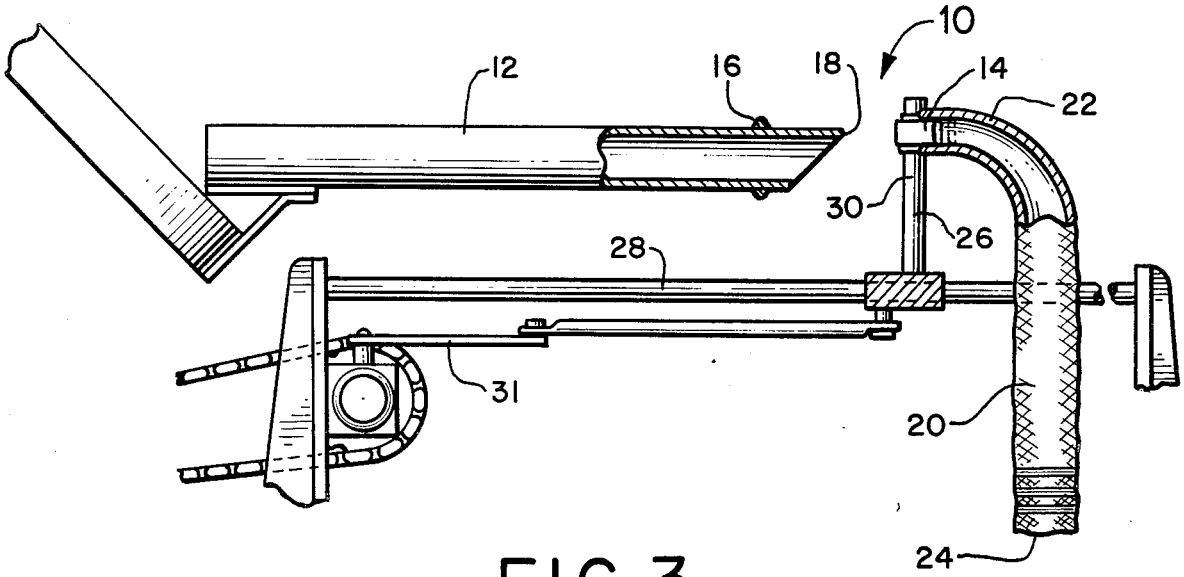
FIG. 1 is a partially cutaway elevated side view of a mechanical everting device embodying features of the present invention.

Referring now to the drawings, particularly to FIG. 1, there is illustrated a mechanical everting device, designated generally by the reference numeral 10, including a modified cylindrical mounting tube 12 and a pair of mechanical gripping fingers 14. The mounting tube 12 includes a first and second end, said first end being a free end 18, and a turning ring 16 disposed rearward of the free end 18 of the tube 12. The turning ring 16 provides frictional resistance to the sliding of a hose blank or sleeve 20 along the mounting tube 12. The turning ring 16 is therefore positioned close to the tube's free end 18 and the tube 12 has sufficient length to allow the sleeve 20 to be drawn past the turning ring 16 whereupon the drawing of the sleeve 20 is reversed, its leading end 22 turning back over the sleeve 20 as it is drawn toward the tube's free end 18. Simultaneous motion of the following end 24 towards the tube's free end 18 is retarded by the turning ring 16.

In general practice, the leading end 22 would be the toe end of the hose sleeve 20 and the process of drawing the whole sleeve 20 over the turning ring 16 and back to the tube's free end 18 both everts the sleeve 20 and positions the leading or toe end 22 free of the end of the mounting tube 12 in a position to be clamped, the preferred position for sewing or stitching the toe end closed.

Figure 2:
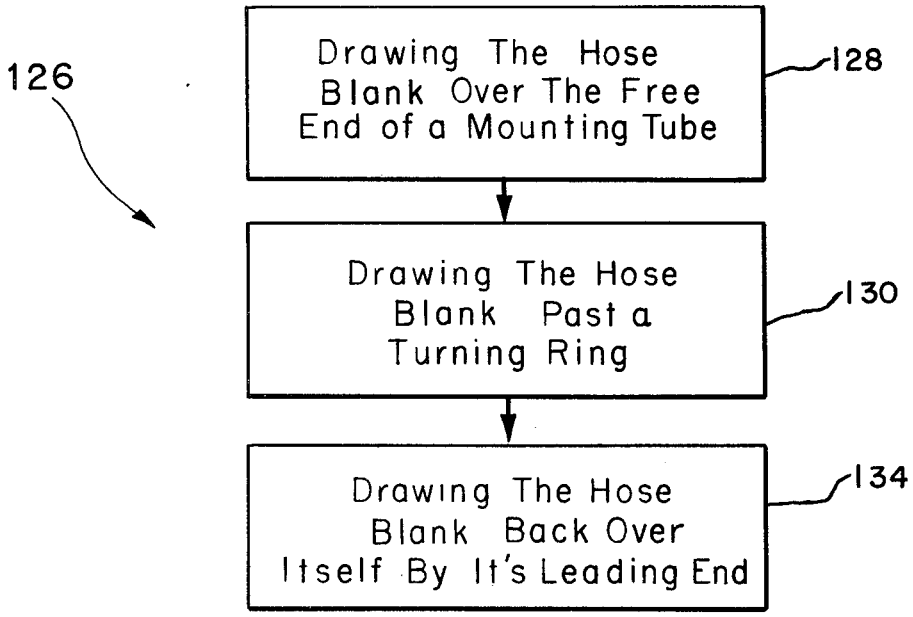
FIG. 2 is a flow diagram of a method embodying features of the present invention.

Referring now to the flow diagram FIG. 2 also, the method, designated generally 126, can be depicted as three steps, drawing a hose blank over the free end of a mounting tube, step 128, drawing the hose blank past the turning ring, step 130, and drawing the hose blank back over itself by its leading end, step 134. All of the individual steps of the method 126 involve the same function, i.e., drawing, and the sleeve 20 can be drawn throughout the method by its leading end 22. This method 126 can be performed easily and quickly by hand. An operator can simply grip the sleeve 20 at its toe or leading end 22, draw it over the tube's free end 18 past the turning ring 16 in one motion, and draw the toe or leading end 22 back to the tube's free end 18 in a second, reverse motion. No vacuum need be applied through the mounting tube 12 during this operation and therefore, in the absence of an applied vacuum, the pair of fingers 14 can also easily perform all of the steps of the method 126.

Figure 3:
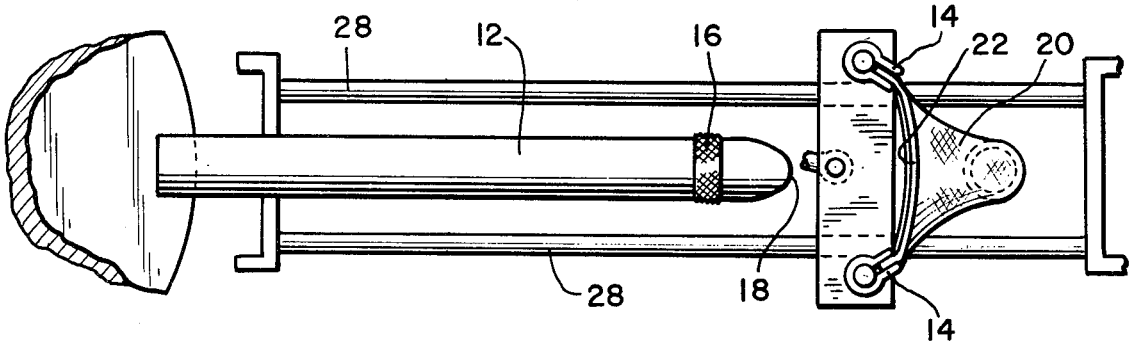
FIG. 3 is a top plan view of a mechanical everting device embodying features of the present invention.
Figure 4:
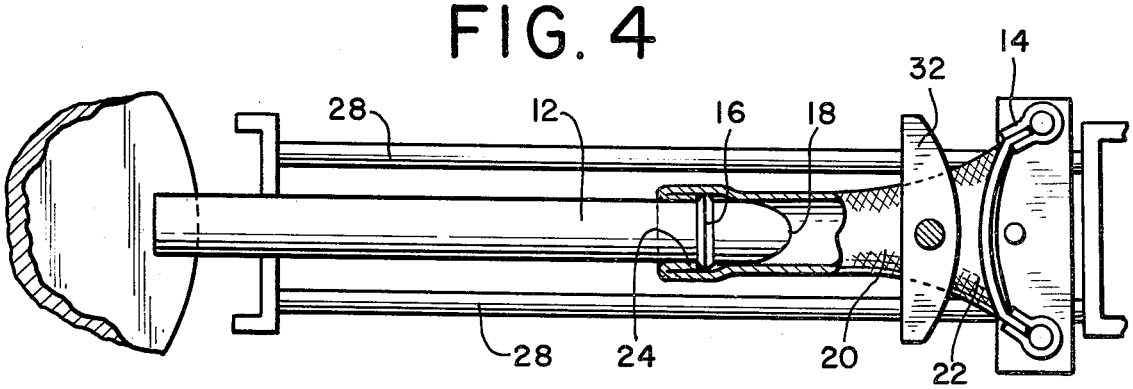
FIG. 4 is a top plan view of a mechanical everting device embodying features of the present invention.

Referring now to FIGS. 3 and 4 also, the two spaced apart pairs of fingers 14 are preferably rotatably mounted on stems 26 to form a gripping assembly 30 supported by guide bars 28. The fingers 14 grip the toe or leading end 22 of the sleeve 20 at opposite positions, and the gripping assembly 30 is moved forward on the guide bars 28 by any convenient and conventional mechanical means, such as the crank assembly 31 illustrated. The fingers are rotatable on the stems 26 and will pull the leading end 22 of the sleeve 20 over the tube's free end 18 and, upon reaching a predetermined position at which the following end 24 of the sleeve 20 has passed the turning ring 16, the movement of the gripping assembly 30 is reversed, the fingers rotate 180°, and the leading end 22 of the hose sleeve is pulled over the rest of the hose sleeve 20 toward the tube's free end 18. Only relatively simple mechanisms are needed to mechanically perform the method 26 because the steps thereof involve the simple function of drawing by the toe or leading end 22 and reversing that function. The selection of a suitable mechanical means for performing the method 126, if desired, is within the ordinary skill of one in the art.

Figure 5:
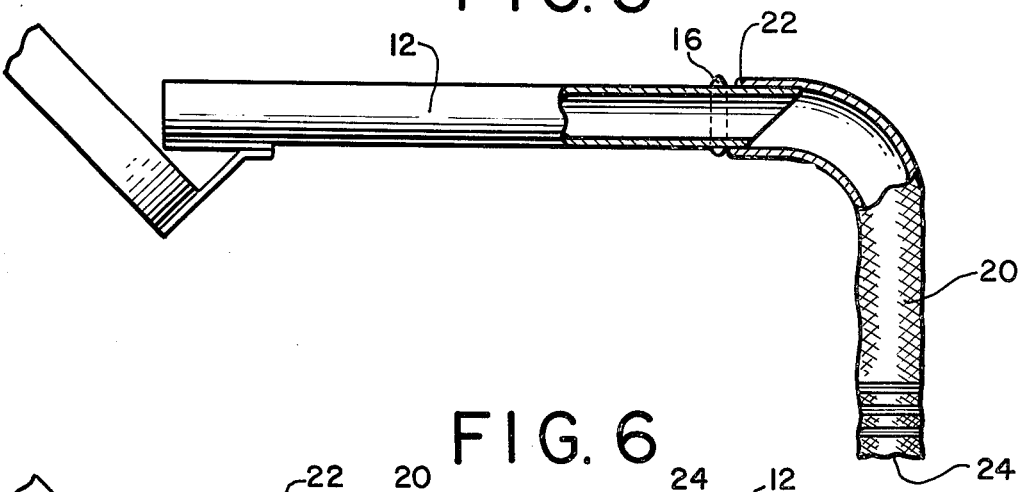
FIGS. 5, 6 and 7 are elevated side views of a sleeve being everted in accordance with the present invention.
Figure 6:
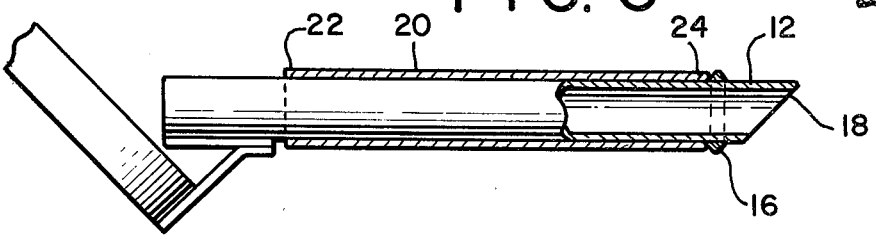
Figure 7:
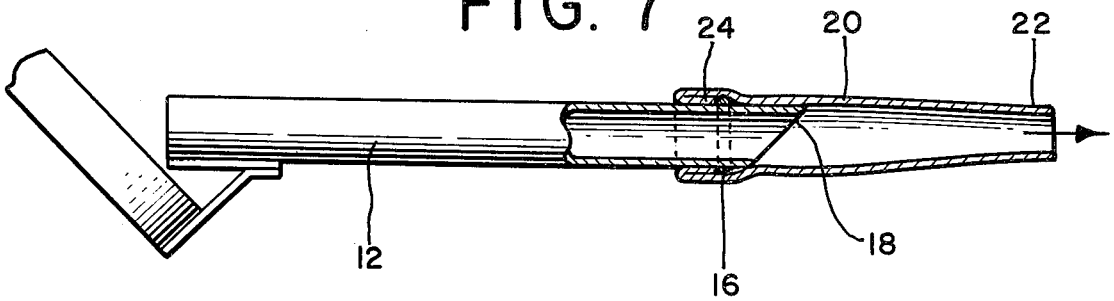

Referring to FIGS. 5, 6, and 7 also, the turning ring 16 provides means for resisting sliding on the tube that is greater than that provided by the surface of the mounting tube 12, or other portions of the mounting tube 12 when the ring 16 is a part of the tube 12 itself. The means for resisting sliding is preferably formed as a ring so that it provides resistance confined to a relatively small area which is met at every side of the mounting tube 12. By resistance to sliding herein is meant a resistance greater than that frictional resistance provided by the surface of the mounting tube 12. When the sleeve 20 is so being everted, the leading end 22 slides over the rest of the sleeve 20 and tends to move the following end 24 in the same direction. Such force on the following end 24 is not as great as the force of direct drawing itself. The turning ring 16 provides sufficient resistance to the sliding of the following end 24 caused by everting the sleeve 20 at the leading end 22, but not sufficient resistance to prevent the sleeve 20 or any part thereof from being drawn over the turning ring 16.

The turning ring 16 can be of any design that provides more frictional resistance than the surface of the mounting tube 12. As illustrated in FIG. 1, it can be an oversize protuberance that provides an abutment as shown in the remaining figures. It can be an area of roughened surface on the mounting tube 12 itself, as shown in FIG. 3. Moreover, the means for resisting sliding need not be formed as a ring but merely be of any design of sufficient resistance to perform the same function. Regardless of the form of the means for resisting sliding, the following end 24 of the sleeve 20 is prevented from sliding past the turning ring 16 and often bunches up at this point.

When formed as a turning ring 16, it may be adjustable on the mounting tube 12 so as to place it closer to, or further from, the tube's free end 18 as desired. The turning ring 16 can be formed as a strap or formed of half rings hinged together or the like so as to be easily mounted on conventional vacuum tubes, adapting them for use in the present invention.

As mentioned above, when the leading end 22 is drawn back to the tube's free end 18, it is in position for closure. The everting device 10 is envisioned as being used in association with a toe clamp 32 and a sewing machine (not shown) with which the toe or leading end 22 can be stitched closed. The fingers 14 draw the leading 22 to the toe clamp 32 for closure. Thereafter, if desired, a vacuum can be applied through the mounting tube 12 and the stitched toe end allowed to be drawn into the mounting tube 12 and re-everted and delivered to the next station in the manufacturing process.

INDUSTRIAL APPLICABILITY

The method of everting hose or hose blanks of the present invention is applicable to mechanical and manual processes for manufacturing hose, such as socks and the like, and is particularly useful for everting a hose blank, formed as a tubular sleeve or the like, to turn it inside out and thereby position the toe end for stitching closed. The present invention is also applicable to everting any knitted sleeve-like piece during the manufacture of a garment or the like.

While several embodiments described herein are at present considered to be preferred, it is understood that various modifications and improvements may be made therein, and it is intended to cover in the appended claims all such modification and improvements as fall within the true spirit and scope of the invention.

I claim:

1. An improved method of processing a knitted sleeve-like item formed as an elongated sleeve with open longitudinal extremities, which comprises:

first drawing an elongated sleeve over a cylindrical mounting tube having a free end whereby the leading end of said sleeve receives said free end;

then continuing drawing said sleeve until the following end of said sleeve passes a means for resisting sliding on said mounting member;

then drawing said sleeve from said leading end in the reverse direction so that said sleeve is drawn back over itself, whereby movement of said sleeve about its following end towards said free end of said mounting member is retarded by said sliding resisting means, until said leading end is drawn beyond said free end of said mounting tube;

then stitching said leading end closed; and then providing a suction through said mounting tube and allowing said sleeve to be drawn into said mounting tube, closed leading end first.

2. The method of claim 1 wherein said sliding resisting means is a ring disposed transverse to longitudinal movement on said mounting tube.

3. The method of claim 2 wherein said ring is oversized, providing a shoulder that retards the sliding of said following end of said sleeve towards said free end of said mounting tube.

4. The method of claim 1 wherein said sliding resisting means is a roughed surface that provides greater frictional resistance to sliding than other surfaces of said mounting tube.

5. The method of claim 1 wherein said toe end is clamped prior to stitching closed.

6. A device for use in the processing of knitted hose comprising:

means for mounting an elongated sleeve comprising a cylindrical mounting tube having a first and second end, said first end being a free end adapted for being received by a leading end of a tubular sleeve;

means for drawing said elongated sleeve forward and backward on said mounting means by the leading end of said sleeve;

means for resisting sliding of the following end of said sleeve when said leading end is being drawn backward on said mounting means, said sliding resisting means being disposed on said mounting tube at a position between its first and second ends;

associated means for clamping said leading end for stitching closed an end of said sleeve, said clamping means being disposed forward of said free end of said mounting tube;

means for providing suction through said mounting tube at said free end of said mounting tube; and said sleeve drawing means comprising two spaced apart pairs of fingers rotatably mounted on slideably mounted gripping assembly, said two pairs of fingers being disposed on opposite sides of said mounting tube and each being rotatable through at least 180°, and means for moving said pairs of fingers between a position between said sliding resisting means and said second end of said mounting tube to a position forward of said free end of said mounting tube.

7. The device of claim 6 where said sliding resisting means is a ring disposed transverse to longitudinal movement on said mounting tube.

8. The device of claim 7 wherein said ring is oversized, providing a shoulder that retards the sliding of said following end of said sleeve towards said free end of said mounting tube.

9. The device of claim 6 wherein said sliding resisting means is a roughed surface that provides greater frictional resistance to sliding than other surfaces of said mounting tube.

10. The device of claim 6 wherein said clamping means comprises a toe clamp disposed between said free end of said mounting tube and an associated sewing means, and wherein said pairs of fingers are moveable to a position between said toe clamp and said sewing means.

* * * * *